US005287678A

United States Patent [19]

Leitzel

[11] Patent Number: 5,287,678

[45] Date of Patent: Feb. 22, 1994

[54] WRAPPING MACHINE

[76] Inventor: Leon J. Leitzel, R.R. 2, Box 126A, Middleburg, Pa. 17842

[21] Appl. No.: 983,651

[22] Filed: Dec. 1, 1992

[51] Int. Cl.[5] ..... B65B 11/00

[52] U.S. Cl. ..... 53/399; 53/441; 53/556; 53/587

[58] Field of Search ..... 53/211, 399, 441, 556, 53/587; 269/267, 274, 902

[56] References Cited

U.S. PATENT DOCUMENTS

| | | | |
|---|---|---|---|
| 1,826,486 | 10/1931 | Walker | 269/274 |
| 3,971,552 | 7/1976 | Mayfield | 269/902 X |
| 3,994,118 | 11/1976 | Felix | 53/587 X |
| 4,077,179 | 3/1978 | Lancaster et al. | 53/211 X |
| 4,271,657 | 6/1981 | Lancaster, III et al. | 53/587 X |
| 4,299,076 | 11/1981 | Humphrey | 53/587 |
| 4,300,326 | 11/1981 | Stackhouse | 53/211 |
| 4,450,668 | 5/1984 | Grossi | 53/587 X |
| 4,461,136 | 7/1984 | Hudson et al. | 53/211 X |
| 4,483,059 | 11/1984 | Dearman | 269/902 X |
| 4,502,264 | 3/1985 | Flaherty | 53/399 |
| 4,519,592 | 5/1985 | Russell | 269/274 X |
| 4,620,408 | 11/1986 | Parnes | 53/556 X |
| 4,858,415 | 8/1989 | Hake | 53/441 X |
| 5,005,813 | 4/1991 | Lawrence | 269/902 X |

*Primary Examiner*—John Sipos
*Assistant Examiner*—Daniel Moon
*Attorney, Agent, or Firm*—Webb, Burden, Ziesenheim & Webb

[57] ABSTRACT

A wrapping machine which includes an elevated platform with a pair of opposed clamping members adapted to hold a narrow workpiece being wrapped therebetween. Each clamping member includes a flat base and a pair of sides for holding a narrow workpiece between the clamping members, with each of the clamping members being rotatably mounted. One of the clamping members is coupled to the platform and the other of the clamping members is coupled to a vertically movable arm. A vertical support is provided to support the vertically movable arm, with a first drive mechanism rotatably driving one of the pair of clamping members, and a second drive mechanism for moving the movable arm relative to the support to position the pair of clamping members with respect to the workpiece being wrapped.

15 Claims, 1 Drawing Sheet

WRAPPING MACHINE

BACKGROUND OF THE INVENTION

The present invention relates to a wrapping machine adapted for wrapping narrow workpieces, such as windows and the like.

Various wrapping machines have been known in the art. The prior art discloses wrapping machines which provide a base upon which a turntable rotatably supports a workpiece. The prior art additionally utilizes vertically movable top clamping members to secure the workpiece between the turntable and the clamping member during the wrapping operation. Examples of these prior art devices can be found in U.S. Pat. Nos. 4,271,657; 4,299,076; 4,450,668; 4,628,667; 4,779,396; 4,807,427; 4,955,181 and 5,046,303. The prior art wrapping machines are generally applicable to workpieces provided with broad bases and are not well-suited to handle relatively narrow workpieces such as windows, frames and the like.

The object of the present invention is to provide a simple, efficient wrapping machine which overcomes the above-identified drawback and is particularly adapted for handling narrow workpieces, such as windows and the like.

SUMMARY OF THE INVENTION

The present invention provides a wrapping machine particularly adapted for narrow workpieces and which includes an elevated platform. A pair of opposed clamping members are adapted to center and hold a narrow workpiece between the clamping members. Each clamping member includes a flat base and a pair of diverging sides for centering and holding the narrow workpiece between the clamping members. Both clamping members are rotatably mounted, with the bottom clamping member coupled to the platform and the top clamping member coupled to a vertically movable arm. A vertical support supports the movable arm. A first drive mechanism rotatably drives one of the clamping members and a second drive mechanism moves the movable arm on the vertical support to position the pair of clamping members with respect to the workpiece. A limit switch may be attached to the movable arm and cooperates with the top clamping member wherein the limit switch will indicate when the clamping members have sufficiently engaged the workpiece. The limit switch may be coupled to the second drive mechanism to stop the second drive mechanism from moving the movable arm toward the platform when the clamping members have sufficiently engaged the workpiece.

In operation, the narrow workpiece is placed on the bottom clamping member which is coupled to the platform. The second drive mechanism is driven whereby the movable arm is moved toward the platform until the top clamping member engages the workpiece whereby the workpiece is centered and secured between the clamping members. The first drive mechanism is then driven to rotate the clamping members and the workpiece. The workpiece may be simultaneously wrapped as it is being rotated. Once the workpiece is sufficiently wrapped, the first drive mechanism is stopped and the wrapping material severed from the wrapping roll and attached to the workpiece which has now been wrapped.

A complete understanding of the invention will be obtained from the following description when taken in connection with the accompanying drawing, wherein like reference characters identify like parts throughout.

BRIEF DESCRIPTION OF THE PREFERRED EMBODIMENT

Figure 1:
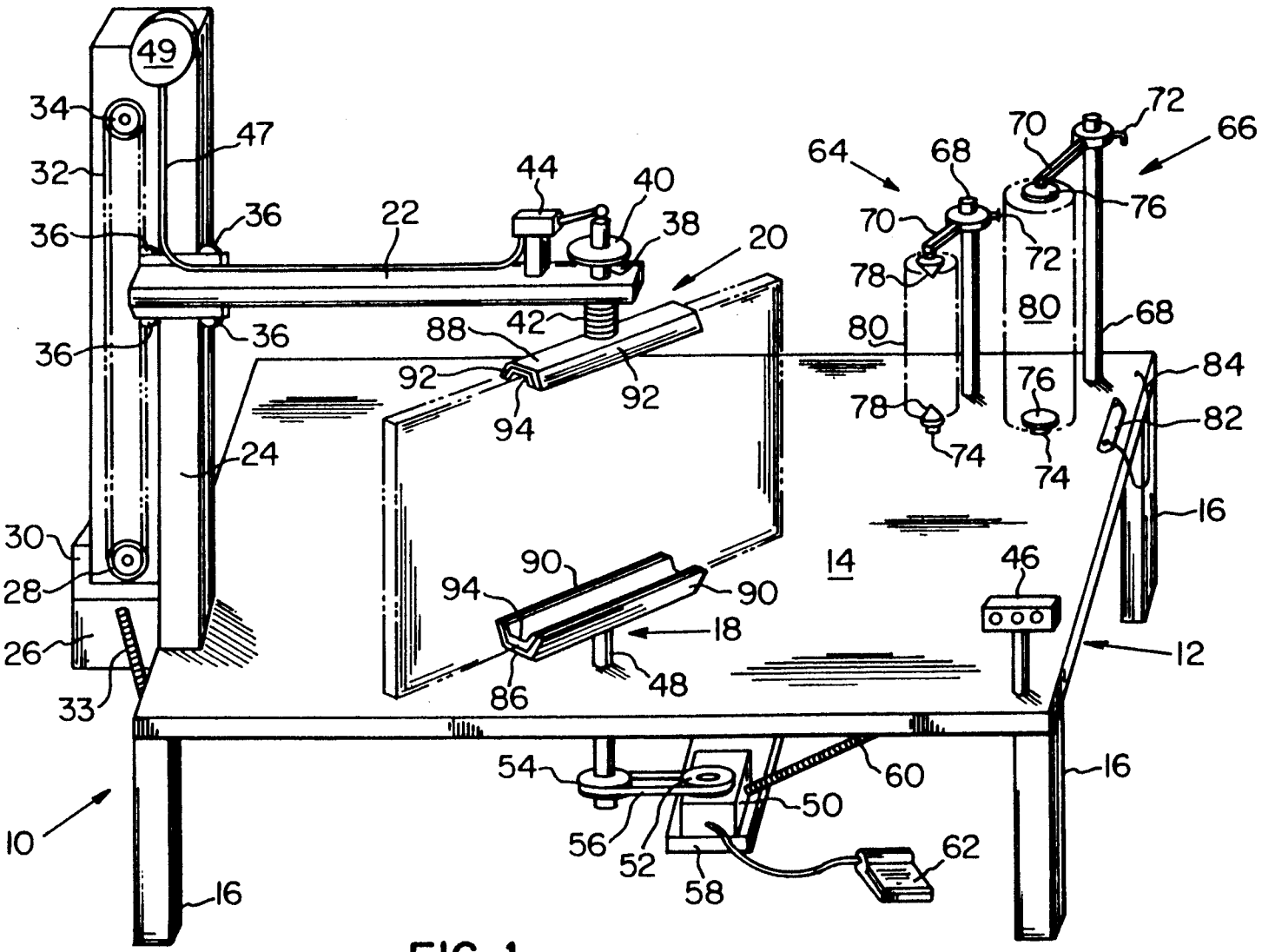
FIG. 1 is a perspective view of a wrapping machine according to the present invention.

As seen in FIG. 1, the wrapping machine 10 includes an elevated platform 12 comprising a flat table surface 14 supported by four legs 16.

A pair of opposed clamping members are provided with a first clamping member 18 supported on the platform 12 and a second clamping member 20 coupled to a vertically movable arm 22. The first and second clamping members 18 and 20 are rotatably mounted in the platform 12 and movable arm 22, respectively.

A vertical support 24 is attached to the platform 12 and supports the movable arm 22. A motor 26 drives a driven sprocket 28 through appropriate gearing 30. A driven chain 32 extends between the driven sprocket 28 and an idle sprocket 34 such that chain 32 extends substantially the entire length of the vertical support 24. A tensioning spring 33 extends between motor 26 and platform 12 to maintain tension on chain 32. The chain 32 is attached to the movable arm 22 whereby driving the driven sprocket 28 by the motor 26 will move the chain 32 and the attached movable arm 22 up and down the length of the vertical support 24. Rollers 36 are provided between the movable arm 22 and the vertical support 24.

The second clamping member 20 includes a shaft 38 which extends through the movable arm 22. A retaining flange 40 is attached to the shaft 38 to maintain the coupling between the movable arm 22 and the second clamping member 20. A spring 42 extends between the movable arm 22 and the second clamping member 20 to bias the second clamping member 20 away from the movable arm 22 and toward the first clamping member 18.

A limit switch 44 is attached to the movable arm 22 and cooperates with the second clamping member 20 to indicate when the clamping members 18 and 20 have sufficiently engaged a workpiece (shown in phantom).

As the movable arm 22 is lowered, the second clamping member 20 will engage the workpiece positioned on top of the first clamping member 18. After engagement with the workpiece, the movable arm 22 will continue to move down while the second clamping member 20 is held in position by the workpiece, thereby compressing the tension spring 42. The shaft 38 will eventually contact and trigger the limit switch 44, thereby indicating that the clamping members have sufficiently engaged the workpiece. The limit switch 44 is coupled to the motor 26 through cord 47, cord reel 49 and another cord (not shown) extending between the cord reel 49 and the motor 26. This connection allows the limit switch 44 to turn off the motor 26 upon proper engagement of the clamping members 18 and 20 with the workpiece. The motor 26 is preferably activated by a control unit 46 attached to the platform 12. The control unit 46 will preferably operate the motor 26 in a forward or reverse direction, subject to the operation of limit switch 44 which will override the control of control unit 46. When the limit switch has been activated, the control unit 46 will not be able to operate the motor in a forward direction, but will be able to operate the motor 26 in a reverse direction sufficient to move the movable arm 22 away from the table 14 to thereby release the workpiece held between the clamping members 18 and 20 and reset the limit switch 44.

The first clamping member 18 includes a shaft 48 rotatably mounted in the platform 12. A motor 50 drives a first pulley 52 which is coupled by a drive belt 56 to a second pulley 54 attached to the shaft 48. The motor 50 is supported on a pivotable beam 58. A tensioning spring 60 extends between the motor 50 and the platform 12 to pivot the pivotable beam 58 and motor 50 to maintain tension in the drive belt 56. The motor 50 may be operated by a shielded treadle 62 positioned below the platform 12. The present arrangement allows for ease of replacement for the various parts of the driving mechanism for the first clamping member 18. To replace or repair any of the parts, the tensioning spring 60 is removed allowing easy disconnection of the drive belt 56 and appropriate repair or replacement of any of the associated parts.

In operation, the motor 50 may be operated by the shielded treadle 62 to turn the first clamping member 18. The first clamping member 18 will be turned preferably when the workpiece has been securely engaged between the first and second clamping members 18 and 20, respectively. This will allow for easy turning and wrapping of the workpiece held between the clamping members 18 and 20.

On the platform 12 are provided a pair of roll stands 64 and 66, respectively. Each roll stand includes a vertical post 68 and an adjustable bracket 70 secured on the post 68 by locking member 72. Each roll stand 64 and 66 includes a corresponding roll base 74. The bracket 70 and roll base 74 may be provided with roll engaging studs 76 or self-centering roll-engaging cones 78. It is preferable that a first roll stand 64 be smaller than the second roll stand 66; for example, roll stand 64 is a 40" roll stand while roll stand 66 is a 60" roll stand. The roll stands 64 and 66 are each adapted to removably receive a conventional roll of wrapping material 80. A blade 82 may be positioned near the roll stands 64 and 66 such that the roll of wrapping material 80 may be easily severed upon completion of wrapping of the workpiece. A chain 84 may attach the blade 82 to the platform 12 or roll stand 64 or 66 to assure that the blade 82 is not misplaced or lost.

The clamping members 18 and 20 are specifically adapted to center and hold a narrow workpiece therebetween. Each clamping member 18 and 20 includes a flat base 86 and 88, respectively. Each base 86 and 88 is attached to a pair of diverging sides 90 and 92, respectively, which center and hold the narrow workpiece between the clamping members 18 and 20. Additionally, padding 94 may be provided on one or both clamping members 18 and 20 to provide for cushioning of the workpiece and preventing the workpiece from being marred or otherwise damaged by the clamping members 18 and 20. The clamping members 18 and 20 are specifically adapted to center and hold narrow workpieces such as windows, picture frames and the like. Additionally, U-shaped clamping members, such as where the sides are at right angles to the base, may be utilized, particularly when workpieces of a constant width are being wrapped.

In operation, the user will place the workpiece to be wrapped on top of the clamping member 18. Diverging sides 90 will operate to center the workpiece on top of base 86. The operator activates motor 26 in a forward direction through control unit 46. This will cause the movable arm 22 to move toward the platform 12. The movable arm 22 will continue to move toward the platform 12 until the clamping member 20 engages with the workpiece. Once the clamping member 20 has engaged with the workpiece, the shaft 38 will activate limit switch 44 and cut off motor 26. When the clamping member 20 engages the top of the workpiece, diverging sides 92 will center the workpiece on base 88. The operator can now turn the workpiece for wrapping by operating motor 50 through operation of the treadle 62. The motor 50 drives the lower clamping member 18, the attached workpiece and upper clamping member 20. As the workpiece is turning, the workpiece may be easily wrapped through use of the wrapping material from the roll of wrapping material 80 contained on one of the roll stands 64 or 66. When the workpiece has been sufficiently wrapped, the operator stops the rotation of the workpiece by stepping off the treadle 62 which cuts off motor 50. The wrapping material is severed from the roll of wrapping material 80 through use of blade 82. The excess wrapping material surrounding the workpiece can be taped down or secured in another suitable fashion. The workpiece is removed f rom the clamping members 18 and 20 by operating the motor 26 in a reverse direction through use of control unit 46. Driving motor 26 in reverse will move the movable arm 22 away from the platform 12 and disengage the clamping member 20 from the workpiece. As the movable arm 22 moves away from the platform 12 and the workpiece, spring 42 will move shaft 38 away from limit switch 44 until retaining flange 40 engages with the movable arm 22. When the shaft 38 disengages from the limit switch 44, the motor 26 can be operated in the forward direction through use of the control unit 46. The wrapped workpiece is removed and the wrapping machine 10 is ready to receive another workpiece, and the process is repeated.

While a specific embodiment of the invention has been described in detail herein, it will be appreciated by those skilled in the art that various modifications and alternatives to the embodiment could be developed in light of the overall teachings of the disclosure. For example, a motor may be provided on the movable arm 22 to rotate the second clamping member 20 in place of the motor 50. Accordingly, the particular arrangement is illustrated only and is not limiting as to the scope of the invention which is to be given the full breadth of the appended claims and any and all equivalents thereof.

I claim:

1. A wrapping machine comprising:

an elevated platform;

a pair of opposed clamping members adapted to hold a thin workpiece being wrapped therebetween, each said clamping member including a substantially horizontal flat base and a pair of sides extending beyond said base to surround and engage the sides of said thin workpiece for centering and holding said thin workpiece between said clamping members, wherein each said pair of sides diverges from each other in a direction extending away from said horizontal base for centering said thin workpiece, and wherein said clamping members are rotatably mounted;

one of said pair of clamping members coupled to said platform and configured to support said thin workpiece, and the other of said clamping members positioned vertically above said one clamping member and coupled to a vertically movable arm;

a vertical support supporting said vertically movable arm.

a first drive means rotatably driving one of said pair of clamping members; and a second drive means for moving said movable arm on said vertical support to position said pair of clamping members with respect to said thin workpiece.

2. The wrapping machine of claim 1 further including a limit switch attached to said movable arm and cooperating with said clamping member which is coupled to said movable arm to indicate when said clamping members have engaged a workpiece.

3. The wrapping machine of claim 2 wherein said limit switch is coupled to said second drive means to stop said second drive means from moving said movable arm toward said platform when said clamping members have engaged a workpiece.

4. The wrapping machine of claim 1 further including a spring which biases said clamping member which is coupled to said movable arm toward said clamping member which is coupled to said platform.

5. The wrapping machine of claim 1 further including at least one roll stand attached to said platform.

6. The wrapping machine of claim 5 wherein a pair of said roll stands are provided with a first roll stand being larger than a second roll stand.

7. The wrapping machine of claim 5 wherein each said roll stand is adjustable.

8. The wrapping machine of claim 1 further including:

a first control means controlling said first drive means; and a second control means controlling said second drive means.

9. The wrapping machine of claim 8 wherein said second control means is attached to said platform and said first control means is a treadle positioned below said platform.

10. The wrapping machine of claim 1 wherein said first drive means includes a first motor and a drive belt operatively connecting said first motor to said clamping member which is coupled to said platform.

11. The wrapping machine of claim 10 wherein said second drive means includes a second motor operatively coupled to a driven sprocket, and a chain coupled to said driven sprocket and said movable arm.

12. The wrapping machine of claim 11 further including a limit switch attached to said movable arm and cooperating with said clamping member which is coupled to said movable arm to indicate when said clamping members have engaged a workpiece.

13. The wrapping machine of claim 1 wherein at least one of said clamping members includes cushioning members.

14. A wrapping machine comprising:

an elevated platform;

a pair of opposed clamping members adapted to hold a thin workpiece being wrapped therebetween, each said clamping member including a substantially horizontal flat base and a pair of sides extending beyond said base to surround and engage the sides of said thin workpiece for centering and holding said thin workpiece between said clamping members, wherein each said pair of sides diverges from each other in a direction extending away from said horizontal base for centering said thin workpiece, and wherein said clamping members are rotatably mounted;

one of said pair of clamping members rotatably coupled to said platform and configured to support said thin workpiece, and the other of said clamping members positioned vertically above said one clamping member and coupled to a vertically movable arm;

a vertical support supporting said vertically movable arm;

a first drive means rotatably driving one of said pair of clamping members, wherein said first drive means includes a first motor and a drive belt operatively connecting said first motor to said clamping member which is coupled to said platform; and a second drive means for moving said movable arm on said vertical support to position said pair of clamping members with respect to said thin workpiece;

wherein said first drive means further includes a tensioning spring between said first motor and said platform to maintain said drive belt in tension.

15. A method of wrapping a narrow workpiece using a wrapping machine including:

an elevated platform;

a pair of opposed clamping members adapted to hold a thin workpiece being wrapped therebetween, each said clamping member including a substantially horizontal flat base and a pair of diverging sides extending beyond said base for centering and holding said thin workpiece between said clamping members, wherein each said pair of sides diverges from each other in a direction extending away from said horizontal base for centering said thin workpiece, and wherein said clamping members are rotatably mounted;

one of said pair of clamping members rotatably coupled to said platform configured to support said thin workpiece, and the other of said clamping members positioned vertically above said one clamping member and coupled to a vertically movable arm;

a vertical support supporting said vertically movable arm;

a first drive means rotatably driving one of said pair of clamping members; and a second drive mans for moving said movable arm on said support to position said pair of clamping members with respect to said thin workpiece;

said method comprising the steps of:

placing said thin workpiece on said one clamping member which is coupled to said platform, wherein said one clamping member supports said thin workpiece;

driving said second drive means whereby said movable arm is moved closer to said platform and said thin workpiece is centered and held between said clamping members;

driving said first drive means to rotate said clamping member and said thin workpiece; and wrapping said thin workpiece simultaneously with said driving of said first drive means.

* * * * *

UNITED STATES PATENT AND TRADEMARK OFFICE

CERTIFICATE OF CORRECTION

PATENT NO. : 5,287,678

DATED : February 22, 1994

INVENTOR(S) : Leon J. Leitzel

It is certified that error appears in the above-indentified patent and that said Letters Patent is hereby corrected as shown below:

Column 4 Line 26 "f rom" should read --from--.

Claim 1 Line 5 Column 5 "arm." should read --arm;--.

Claim 15 Line 64 Column 6 "member" should read --members--.

Signed and Sealed this

Fourteenth Day of June, 1994

Bruce Lehman

*Attest:*

BRUCE LEHMAN

*Attesting Officer*

*Commissioner of Patents and Trademarks*